US006152532A

United States Patent [19]

Cosentino

[11] Patent Number: 6,152,532

[45] **Date of Patent: *Nov. 28, 2000**

[54] SHAPE-ADJUSTING MECHANISM

[75] Inventor: Cesare Christopher Cosentino, Bolton, Canada

[73] Assignee: Schukra Manufacturing Inc., Etobicoke, Canada

[ * ] Notice: This patent is subject to a terminal disclaimer.

[21] Appl. No.: 09/460,260

[22] Filed: Dec. 13, 1999

Related U.S. Application Data

[63] Continuation of application No. 09/143,108, Aug. 28, 1998, Pat. No. 6,036,265.

[51] Int. Cl.[7] ..... A47C 3/025

[52] U.S. Cl. ..... 297/284.4; 297/284.1

[58] Field of Search ..... 297/284.4, 284.1

[56] References Cited

U.S. PATENT DOCUMENTS

| | | | |
|---|---|---|---|
| 1,743,377 | 1/1930 | Nadell . | |
| 3,378,299 | 4/1968 | Sandor | 297/284 |
| 3,762,769 | 10/1973 | Poschl | 297/284 |
| 4,153,293 | 5/1979 | Sheldon | 297/284 |
| 4,313,637 | 2/1982 | Barley | 297/284 |
| 4,316,631 | 2/1982 | Lenz et al. | 297/284.1 |
| 4,354,709 | 10/1982 | Schuster | 297/284.4 X |
| 4,359,245 | 11/1982 | Franke | 297/284 |
| 4,601,514 | 7/1986 | Meiller | 297/284 |
| 4,627,661 | 12/1986 | Ronnhult et al. | 297/284.4 |
| 4,632,454 | 12/1986 | Naert | 297/284.4 |
| 4,650,247 | 3/1987 | Berg et al. | 297/284 |
| 4,676,550 | 6/1987 | Neve De Mevergnies | 297/353 |
| 4,880,271 | 11/1989 | Graves | 297/284.4 |
| 4,909,568 | 3/1990 | Dal Monte | 297/284.4 |
| 4,968,093 | 11/1990 | Dal Monte | 297/284.4 |
| 5,026,116 | 6/1991 | Dal Monte | 297/284.1 |
| 5,050,930 | 9/1991 | Schuster et al. | 297/284.4 |
| 5,197,780 | 3/1993 | Coughlin | 297/284.4 X |
| 5,217,278 | 6/1993 | Harrison et al. | 297/284.4 X |
| 5,335,965 | 8/1994 | Sessini . | |
| 5,385,531 | 1/1995 | Jover | 297/284.1 X |
| 5,397,164 | 3/1995 | Schuster et al. | 297/284.4 |
| 5,518,294 | 5/1996 | Ligon, Sr. et al. | 297/284 |
| 5,553,917 | 9/1996 | Adat et al. | 297/230 |
| 5,626,390 | 5/1997 | Schuster et al. | 297/284.4 |
| 5,775,773 | 7/1998 | Schuster et al. | 297/284.4 |

FOREIGN PATENT DOCUMENTS

| | | | |
|---|---|---|---|
| 2040794 | 7/1971 | Germany | 297/284.4 |
| 2345254 | 4/1974 | Germany | 297/284.4 |
| 2804703 | 8/1979 | Germany | 297/284.4 |
| 587924 | 1/1978 | U.S.S.R. | 297/284.4 |
| 2013487 | 8/1979 | United Kingdom | 297/284.4 |

*Primary Examiner*—Anthony D. Barfield
*Attorney, Agent, or Firm*—Howard & Howard

[57] ABSTRACT

A shape-adjusting mechanism for a backrest has a lumbar basket which includes a pair of supports spaced apart along a predetermined axis. Resilient axial ribs are fastened between the brackets, and resilient transverse ribs are fastened to the axial ribs. The axial ribs are structured to flex as the supports are drawn together, to achieve a profile that better conforms to the shape of a user's spine. To that end, each axial rib is stamped with reinforcing flanges that extend partially along its length and produce lengthwise rib sections of different bending resistance that determine the profile of the lumbar basket in its flexed state. No separate stiffening component or additional stamping operation is required.

5 Claims, 3 Drawing Sheets

SHAPE-ADJUSTING MECHANISM

This is a continuation of application(s) Ser. No. 09/143,108 filed on Aug. 28, 1998 now U.S. Pat. No. 6,036,265.

FIELD OF THE INVENTION

The invention relates generally to mechanisms for adjusting the shape of a backrest, and more particularly, to mechanisms with lumbar baskets which conform more closely to the curvature of the human spine and to methods of constructing such mechanisms.

BACKGROUND OF THE INVION

Mechanisms insertable into a backrest to adjust shape and provide better lumbar support are known. Examples are found in U.S. Pat. Nos. 5,050,930 and 5,397,164 to Schuster et al.

Prior art mechanisms comprise a shaping element, commonly referred to as a "lumbar basket", which is mounted for displacement along a guide track. The lumbar basket may have various configurations. A basic construction involves a pair of brackets displaceable along an axis of the guide track, resilient axial ribs joining the brackets, and resilient transverse ribs fixed centrally to the axial ribs with free ends extending laterally to either side of the axial ribs to provide a cushioning effect. Various mechanisms can be used to draw the brackets together in order to flex the lumbar basket from a relative flat rest state to various bowed states. Various mechanisms can also be used to displace the lumbar basket axially along the track. Thus, the curvature of the lumbar basket and its position within a backrest can be adjusted to provide greater comfort.

The basic lumbar basket described above has a flexed profile which is essentially a segment of a circle, and consequently does not conform adequately to the curvature of a user's spine. A prior art approach to altering the flexed profile involves fixing a partial central rib to an upper bracket and an upper set of the transverse ribs, making the upper end of the basket more rigid. This induces greater flexing of the basket proximate to the lower bracket, providing greater comfort for many users. There are, however, shortcomings to such an approach. Making the partial rib and then fastening it to multiple components of the basic lumbar basket contributes to cost There is also little freedom to specify the profile ultimately presented by the basket. Various alternatives can be envisaged to produce baskets that flex to various profiles; however, the basic prior art lumbar basket is simple, and it would be desirable to avoid introducing components and manufacturing steps.

BREIF SUMMARY OF THE INVENTION

In one aspect, the invention provides a shape-adjusting mechanism insertable into a backrest to present a desired profile. The mechanism includes a lumbar basket which has a pair of supports spaced-apart along an axis. One or more resilient axial ribs are fixed to the supports so that the axial ribs flex in a predetermined direction as the supports are displaced towards one another, and resilient traverse ribs are fixed to the axial ribs. Means are provided to displace the supports to flex the axial ribs. To control flexing, each axial rib is structured to have lengthwise sections with different resistance to bending in the predetermined direction. For example, each axial rib may have a lengthwise section of relatively low bending resistance proximate to a selected support and another lengthwise section of relatively high bending resistance proximate to the other support. The flexing of the axial ribs is thus more pronounced proximate to the selected support, and the lumbar basket may be installed in a backrest with the selected support lowermost where the pronounced flexing better conforms to the curvature of a users spine. More generally, lengthwise sections of different bending resistance can be located along each axial rib to achieve various preselected profiles which are felt to be appropriate. This approach eliminates the need to make additional components, such as partial stiffening ribs, and to affix such additional components to the basket.

Each axial rib is preferably stamped with its sections of different bending resistance formed during stamping. Although an axial rib may for such purposes be stamped with various cross-sections selected to impart different rigidity to different lengthwise sections of the rib, a preferred approach is to stamp each axial rib as an elongate strap with transverse reinforcing flanges bent along its lateral edges. The reinforcing flanges can be inclined at various angles relative to the general plane of the strap to select the relative structural rigidity of the different lengthwise sections. Apart from providing profile control without having to make additional stiffening components, the process involves fewer rmanufacturing steps than required for a basic prior art lumbar basket reinforced with one or more partial ribs.

Other aspects of the invention will be apparent from a description below of preferred embodiments and will be more specifically defined in the appended claims.

DESCRIPTION OF THE DRAWINGS

The invention will be better understood with reference to drawings in which.

DESCRIPTION OF PREFERRED EMBODIMENTS

Figure 1:
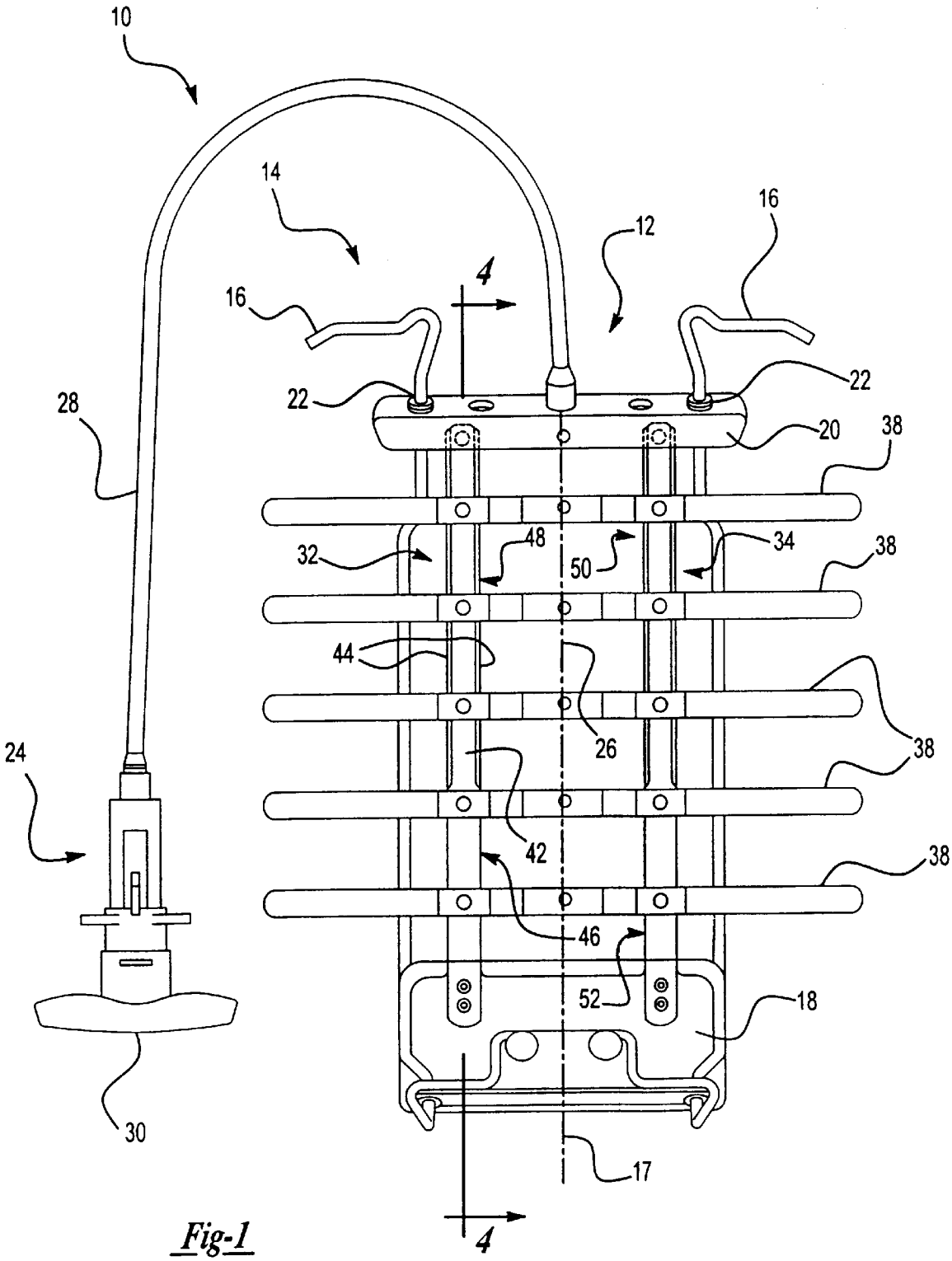
FIG. 1 is plan view-showing a shape-adjusting mechanism.

A general description will be provided with reference to FIGS. 1–4 of a shape-adjusting mechanism 10 insertable into a backrest (not illustrated). The mechanism 10 includes a lumbar basket 12 and a guide track 14 which consists of a pair of steel rods 16 in general alignment with an axis 17. The lumbar basket 12 has a pair of steel brackets (supports) 18, 20. The upper bracket 20 carries a pair of low-friction sleeves 22 that receive the rods 16 of the guide track 14. The lower bracket 18 is similar adapted for retention and displacement on the rods 16. A conventional cable mechanism 24 can be manually operated to flex the lumbar basket 12. The mechanism 24 includes a cable 26 attached to the lower bracket 18 and extending through the upper bracket 20, and a sheath 28 surrounding the cable 26 and butted against the upper bracket 20. A handle 30 can be rotated to draw the cable 26 through the sheath 28, displacing the brackets 18, 20 axially towards one another and flexing the basket 12. The handle 30 can be rotated in an opposite direction to release the cable 26 through the sheath 28, allowing the brackets 18, 20 to separate under the resilience of the basket 12. As well, a mechanism (not shown) will typically be provided to displace the brackets 18, 20 together along the track 14 for purposes of positioning the lumbar basket 12. The components can be mounted to a common support structure insertable into a backrest or separately mounted within the backrest, as has been done in the prior art.

The lumbar basket 12 includes an identical pair of resilient axial steel ribs 32, 34 extending between the brackets 18, 20 in mutually parallel, spaced-apart relationship aligned with the axis 17. Ends of the axial ribs 32, 34 are secured with rivets to the brackets 18, 20. Resilient steel traverse ribs 38 are centrally riveted to the pair of axial ribs 32, 34 in mutually parallel, spaced-apart relationship with their free ends extending laterally to either side of the axial ribs 32, 34. As the brackets 18, 20 are drawn together along the track 14, the axial ribs 32, 34 flex outwardly in a direction 40 (indicated in FIG. 4).

Figure 2:
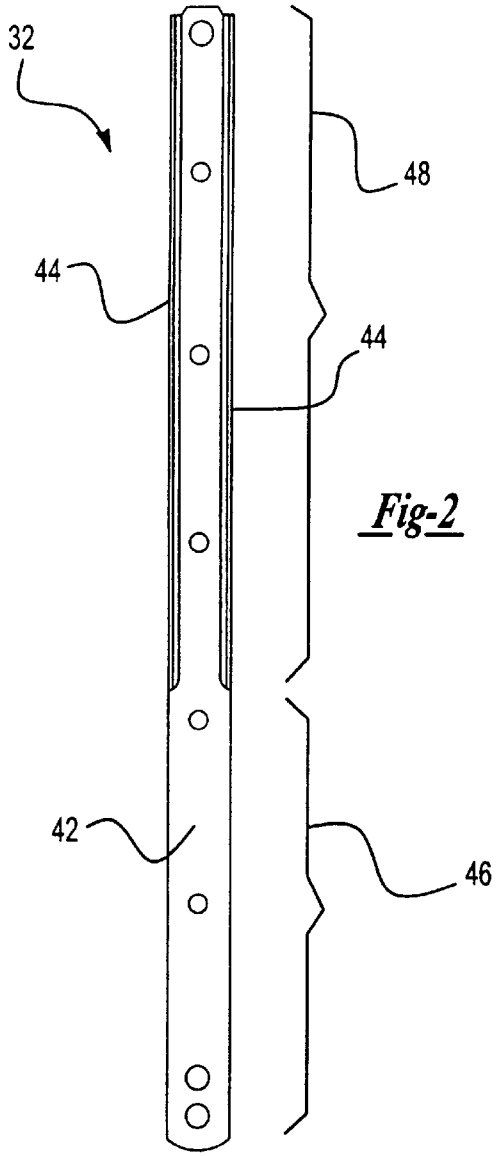
FIGS. 2 and 3 are respectively a plan view and an end view of an axial rib of the lumber basket; and, FIG. 4 is a view along lines 4—4 of FIG. 1 showing the profile of the lumbar basket in a rest state (in solid outline) on which has been superimposed the profile of the lumbar basket in its flexed state (phantom outline)
Figure 3:
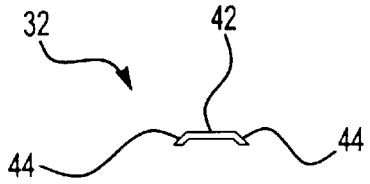

The axial rib 32 is detailed in FIGS. 2 and 3. It consists of a lengthwise planar strap 42 and a pair of reinforcing flanges 44 extending along opposing lateral sides of the strap 42 and oriented transverse to the plane of the strap 42. One lengthwise section 46 of the axial rib 32 is defined solely by the planar strap 42 and has a uniform rectangular transverse cross-section which imparts relatively low resistance to bending in the direction 40. Another lengthwise section 48 is defined by the strap 42 together with the reinforcing flanges 44, and has a uniform channeled transverse cross-section (apparent in FIG. 3) which imparts relatively high resistance to bending in the direction 40. As apparent in FIG. 3, the flanges 44 are inclined at an angle of about 45 degrees to the strap 42. The lengthwise section 46 of relatively low bending resistance extends from the lower bracket 18 toward the upper bracket 20 and the other lengthwise section 48 of relatively high bending resistance extends from the upper bracket 20 toward the lower bracket 18, meeting the lengthwise section 46 centrally between the brackets 18, 20. The other axial rib 34 is similarly fixed to the brackets 18, 20 with its lengthwise section 50 of high bending resistance proximate to the upper bracket 20 and its lengthwise section 52 of low bending resistance proximate to the lower bracket 18. In practice, sections of axial ribs which have corresponding bending resistance (e.g. sections 46, 50 of low resistance or sections 48, 52 of high resistance) are registered in a direction perpendicular to the axis along which supports displace, to provide for uniform flexing of the lumbar basket.

Figure 4:
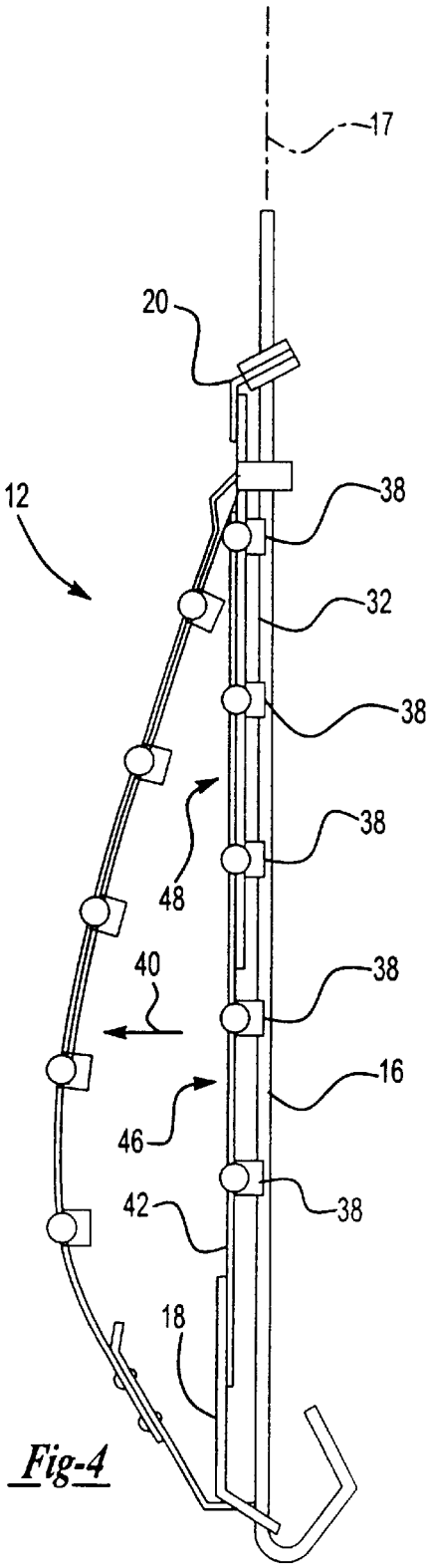

In a rest orientation, the lumbar basket 12 is substantially flat as shown in solid outline in FIG. 4. As the cable mechanism 24 is operated to draw the brackets 18, 20 together, the axial ribs 32, 34 flex outwardly in the direction 40, as shown in phantom outline in FIG. 4. The flexing of the axial ribs 32, 34 is more pronounced proximate to the lower bracket 18 and conforms more closely to the curvature of a user's spine. The relative rigidity of lengthwise sections of the axial ribs 32, 34 required to flex to other preselected profiles can be determined empirically. As a guide, exemplary characeristics of the axial ribs 32, 34 are as follows: general thickness, about 1 millimeter (mm.); strap length, about 250 mm.; strap width, about 15 mm.; flange length, about 140 mm.; flange height measured perpendicular to strap, about 2.5 mm. The steel of the ribs may be conventional steel used in prior baskets. It should be noted that the lumbar basket 12 is a simple implementation of the invention, which is expected to be adequate for most users, but not necessarily all.

The mechanism 10 can be manufactured at lower cost than prior art mechanism whose flexed profile is adjusted with partial stiffening ribs. The guide track 14, the brackets 18, 20, and the cable mechanism 24 may be constructed in a conventional manner. Sheet metal is stamped to produce the axial ribs 32, 34 and the transverse ribs 38. The stamping operation defines the planar strap and the pair of reinforcing flanges that serve to define lengthwise sections of different bending resistance in each axial rib 32, or 34. It should be noted that this stamping operation requires only minor modification of dies and successive steps needed to produce a basic prior lumbar basket but does not involve any additional stamping or processing steps. The transverse ribs 38 are riveted transversely to the axial ribs 32, 34 in mutually parallel, spaced-apart relationship. Ends of the axial ribs 32, 34 are riveted to the brackets 18, 20 with the axial ribs 32, 34 in mutually parallel, spaced-apart relationship. The brackets 18, 20 are fitted to the guide track 14 in a conventional manner, and the cable mechanism 24 is operatively coupled to the brackets 18, 20.

Figure 5:
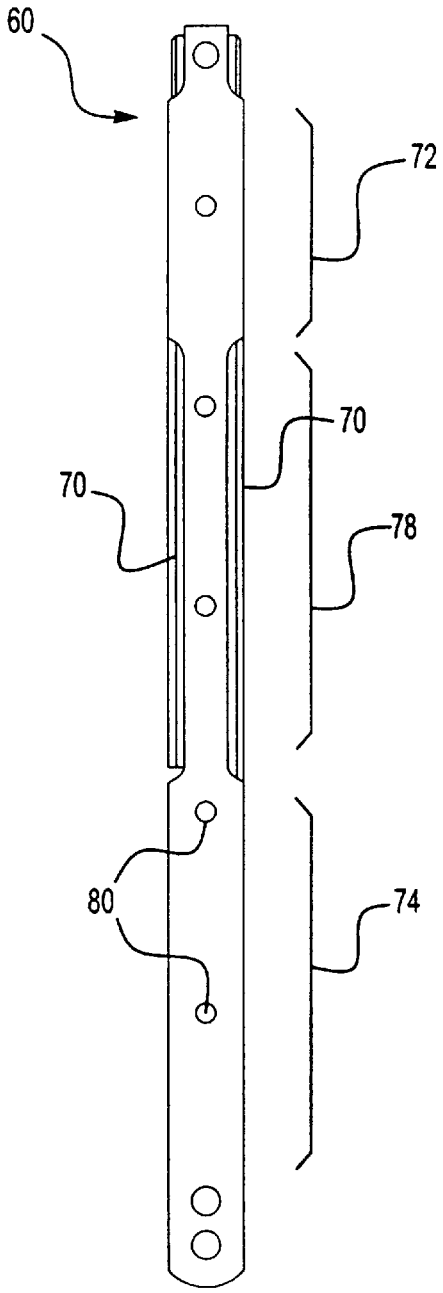
FIG. 5 is a plan view of an alternative axial rib.
Figure 6:
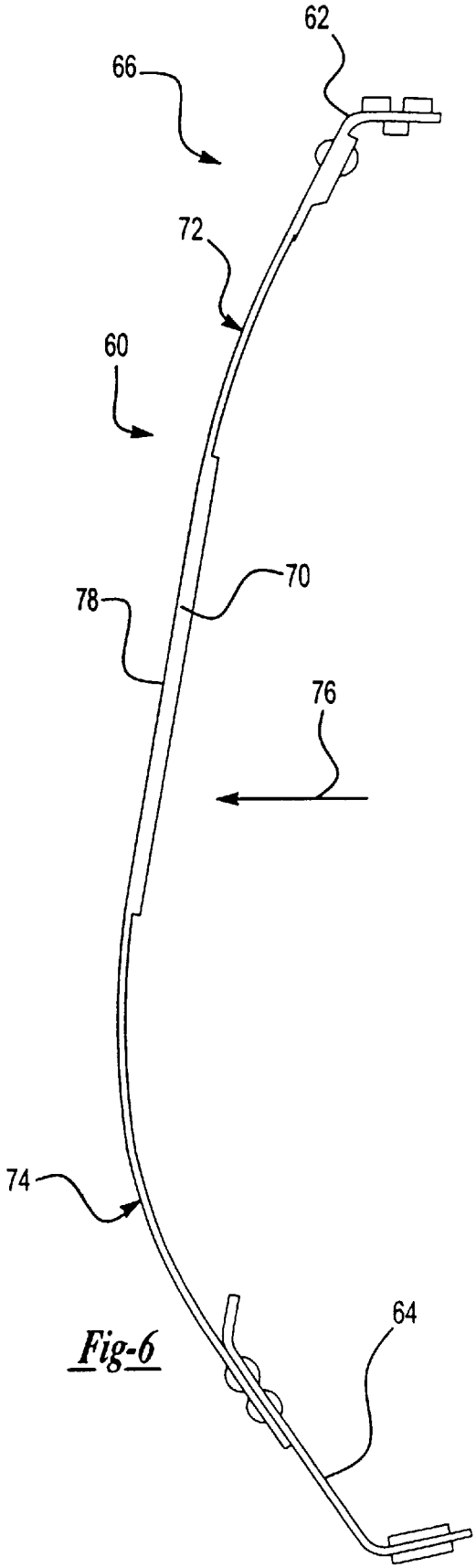
FIG. 6 is a side view showing parts of a lumbar basket incorporating the alternative axial rib.

Reference is made to FIGS. 5 and 6 which show an alternative resilient axial rib 60 stamped from sheet metal, and brackets 62, 64 of an alternative lumbar basket 66 to which the axial rib 60 is fixed together with another identical axial rib (not apparent) in mutually parallel relationship. The axial rib 60 has a central planar lengthwise strap 68 and a pair of reinforcing flanges 70 which are bent towards one another at angles of 45 degrees relative to the general plane of the strap 68 and which extend along opposing side edges of the strap 68. The position of the reinforcing flanges 70 is selected to define a pair of outer lengthwise sections 72, 74 which have relatively low bending resistance in a direction 76 indicated in FIG. 6 and an intermediate section 78 of relatively high bending resistance in the direction 76. Clearance holes (such as the hole 80) are punched into the strap 68 to permitting riveting of transverse ribs (not shown). As apparent in FIG. 6, as the brackets 62, 64 are drawn together, the basket 66 flexes outwardly in the direction 76. The flexing of the axial rib 60 is more pronounced proximate to each of the brackets 62, 64 owing to the pair of relatively weak outer sections 72, 74. Users may find the flexed shape of the alternative lumbar basket 66 more comfortable than that of the lumbar basket 12. Details of construction omitted from FIGS. 5 and 6 will be apparent by reference to the embodiment of FIGS. 14.

The invention permits construction of various lumbar baskets adapted to present various preselected profiles. This can be done by forming the axial rib or ribs with additional reinforcing flanges and selecting the length, inclination and position of the flanges relative to the associated strap, to define multiple lengthwise sections of various bending resistance. Reinforcing flanges are easily stamped and can be inclined to various angles in successive prototypes to arrive at a preselected flexed profile. Although reinforcing flanges are preferred for such reasons, an axial rib can also be produced inexpensively by stamping lengthwise sections with various transverse cross-sections adapted to impart different bending resistance. References in this specification to relatively high and low resistance to bending of sections of an axial rib, and comparable expressions, should be understood as comparative bending resistance of the lengthwise sections, not bending resistance relative to any absolute value.

It will be appreciated that particular embodiments of the invention have been described and that modifications can be made without departing from the spirit of the invention or necessarily departing from the scope of the appended claims. For example, a single wider axial rib can be substituted for the pair of axial ribs used in the preferred embodiments. The construction of the brackets and guide track is not critical, and the brackets can, for example, be fitted with rollers and the guide track adapted to retain and direct movement of the rollers. Although a shape-adjusting mechanism of the invention will often have a track to permit both positioning and flexing of its basket, the track is not required. The lumbar basket can simply be mounted in a fixed position within a backrest as has been done in the prior art.

The embodiments of an invention in which an exclusive property or privilege is claimed are defined as follows:

1. A shape-adjusting mechanism comprising:

a pair of supports spaced-apart along a predetermined axis; and a resilient axial rib having one end fixed to one of the supports and an opposite end fixed to the other of the supports and comprising a lengthwise strap and reinforcing flanges bent from opposing sides of the axial rib and oriented transverse to the strap thereby to define lengthwise sections with different bending resistances in a predetermined direction as the supports are displaced axially towards one another.

2. The shape-adjusting mechanism of claim 1 wherein the axial rib comprises one lengthwise section of relatively low bending resistance extending from the one support toward the other support and another lengthwise section of relatively high bending resistance extending from the other support toward the one support and meeting the one lengthwise section centrally between the supports such that the flexing of the axial rib is more pronounced proximate to the one support.

3. The shape-adjusting mechanism of claim 1 wherein the lengthwise sections comprise a pair of spaced apart lengthwise sections of relatively low bending resistance in the predetermined direction and another lengthwise section of relatively high bending resistance in the predetermined direction located between the pair of lengthwise sections of relatively low bending resistance.

4. The shape-adjusting mechanism of claim 1 wherein the lengthwise sections comprise one lengthwise section stamped with one uniform transverse cross-section and another lengthwise section stamped with another uniform transverse cross-section, the one cross-section selected to impart greater structural rigidity to the one lengthwise section than the other cross-section imparts to the other lengthwise section.

5. The shape-adjusting mechanism as recited in claim 1 further comprising:

means operable to displace the supports axially relative to one another thereby to flex the axial rib.

* * * * *